US008720712B1

(12) United States Patent
Faber

(10) Patent No.: US 8,720,712 B1
(45) Date of Patent: May 13, 2014

(54) FEEDING BOTTLE

(71) Applicant: Katrina D. Faber, Issaquah, WA (US)

(72) Inventor: Katrina D. Faber, Issaquah, WA (US)

( * ) Notice: Subject to any disclaimer, the term of this patent is extended or adjusted under 35 U.S.C. 154(b) by 0 days.

(21) Appl. No.: 13/767,825

(22) Filed: Feb. 14, 2013

(51) Int. Cl.
*A61J 9/00* (2006.01)

(52) U.S. Cl.
CPC *A61J 9/003* (2013.01); *A61J 9/005* (2013.01); *A61J 9/001* (2013.01)
USPC ..... 215/11.3

(58) Field of Classification Search
CPC ..... A61J 9/001; A61J 9/003; A61J 9/005; A61J 11/002; A61J 11/001; A61J 11/006; B65D 25/16
USPC ..... 215/11.3, 11.4, 11.6, 11.1; 220/495.03, 220/723, 720, 259.4, 259.3, 254.8, 495.01
See application file for complete search history.

(56) References Cited

U.S. PATENT DOCUMENTS

| | | | | | |
|---|---|---|---|---|---|
| 2,133,411 | A | * | 10/1938 | Zohe | 215/11.1 |
| 2,372,281 | A | | 3/1945 | Jordan | |
| 2,388,915 | A | | 11/1945 | Herman | |
| 2,480,247 | A | * | 8/1949 | Jamison et al. | 215/11.6 |
| 2,594,114 | A | | 4/1952 | Stephen | |
| 2,665,816 | A | | 1/1954 | Otto | |
| 2,746,634 | A | | 5/1956 | Ceifh | |
| 2,843,281 | A | | 7/1958 | Gallois | |
| 2,987,212 | A | * | 6/1961 | Scanlon | 220/495.03 |
| 3,648,873 | A | * | 3/1972 | Grobbel | 215/11.3 |
| 3,651,973 | A | * | 3/1972 | Yamauchi | 215/11.3 |
| 4,098,397 | A | | 7/1978 | Mann et al. | |
| 4,600,111 | A | | 7/1986 | Brown | |
| 4,623,069 | A | | 11/1986 | White | |
| 4,850,496 | A | | 7/1989 | Rudell et al. | |
| 4,856,995 | A | | 8/1989 | Wagner | |
| 4,880,125 | A | * | 11/1989 | LeBeau | 215/11.3 |
| 4,934,542 | A | * | 6/1990 | Clark, Jr. | 215/11.1 |
| 4,979,629 | A | | 12/1990 | Askerneese | |
| 5,033,631 | A | * | 7/1991 | Nightingale | 215/11.1 |
| 5,060,811 | A | | 10/1991 | Fox | |
| 5,150,800 | A | | 9/1992 | Sarter et al. | |
| 5,301,825 | A | * | 4/1994 | Di Scala et al. | 215/11.1 |
| 5,356,016 | A | * | 10/1994 | Wiedemann | 215/11.3 |
| 5,579,935 | A | * | 12/1996 | Atkin et al. | 215/11.1 |
| 5,588,548 | A | | 12/1996 | Brankley | |
| 5,593,052 | A | | 1/1997 | McGee | |
| 5,617,972 | A | | 4/1997 | Morano et al. | |
| 5,758,786 | A | * | 6/1998 | John | 215/6 |
| 5,758,787 | A | | 6/1998 | Sheu | |
| 5,806,711 | A | | 9/1998 | Morano et al. | |
| 5,878,899 | A | * | 3/1999 | Manganiello et al. | 215/11.6 |
| 6,283,316 | B1 | | 9/2001 | Sherman | |

(Continued)

OTHER PUBLICATIONS

Packaging for Sassy Baby Food Nurser, Sassy, Inc., 2009.

*Primary Examiner* — Robert J Hicks
(74) *Attorney, Agent, or Firm* — Fish & Richardson P.C.

(57) ABSTRACT

A feeding bottle includes a hollow container having an inner surface, a top cap having a center opening, the top cap removably attached to a top portion of the hollow container, a nipple disposed through the top cap's center opening and held in contact by the top cap against the top portion of the hollow container, a collapsible liner disposed within the hollow container and configured to hold food, and a vacuum plate disposed within the hollow container, the vacuum plate having a shape and size such that the vacuum plate remains in moveable contact with the inner surface of the hollow container.

24 Claims, 9 Drawing Sheets

(56) References Cited

U.S. PATENT DOCUMENTS

| | | | | |
|---|---|---|---|---|
| 6,551,639 | B1 | 4/2003 | Nye et al. | |
| 6,616,000 | B1 | 9/2003 | Renz | |
| 6,759,071 | B2 | 7/2004 | Nye et al. | |
| 6,820,767 | B2 | 11/2004 | Nicholas | |
| 6,877,626 | B2 | 4/2005 | Sherrod | |
| 6,884,229 | B2 | 4/2005 | Renz | |
| 6,910,594 | B2 | 6/2005 | Foley et al. | |
| 6,910,595 | B2 * | 6/2005 | Renz | 215/11.6 |
| 6,923,332 | B1 | 8/2005 | Thomas | |
| 6,968,964 | B2 | 11/2005 | Gilmore | |
| 6,981,962 | B1 | 1/2006 | Lenkersdorf | |
| 7,004,339 | B2 | 2/2006 | Renz | |
| D519,784 | S | 5/2006 | Karp | |
| 7,048,137 | B2 | 5/2006 | Leoncavallo et al. | |
| 7,134,564 | B2 | 11/2006 | Verbovszky | |
| D540,119 | S | 4/2007 | Lapsker | |
| 7,225,938 | B2 | 6/2007 | Frisch | |
| 7,234,606 | B2 | 6/2007 | Kraus et al. | |
| D547,610 | S | 7/2007 | Edelstein et al. | |
| D547,875 | S | 7/2007 | Pillado | |
| D548,008 | S | 8/2007 | Lin | |
| 7,303,086 | B2 | 12/2007 | Nhan et al. | |
| D558,524 | S | 1/2008 | Schreitmueller | |
| 7,473,046 | B2 | 1/2009 | Kraus et al. | |
| 7,549,548 | B2 | 6/2009 | Kraus et al. | |
| 7,637,382 | B2 | 12/2009 | Kraus et al. | |
| 7,658,294 | B2 | 2/2010 | Housley et al. | |
| 7,669,725 | B2 | 3/2010 | Randolph et al. | |
| 7,806,298 | B2 | 10/2010 | Kraus et al. | |
| 7,810,662 | B2 | 10/2010 | DeLong | |
| 7,922,032 | B2 | 4/2011 | Mueller et al. | |
| 7,967,160 | B2 | 6/2011 | Rault et al. | |
| 8,051,996 | B1 | 11/2011 | Amaya et al. | |
| 8,061,545 | B2 | 11/2011 | Roth et al. | |
| 2005/0056611 | A1 * | 3/2005 | Hakim | 215/11.6 |

* cited by examiner

FEEDING BOTTLE

FIELD

This specification generally relates to a feeding bottle, for example, for feeding food to a baby.

BACKGROUND

A baby bottle is bottle having a screw-on top and a nipple upon which a baby sucks to extract and drink a liquid (e.g., milk, formula, juice, water) stored within the bottle. Generally speaking, children use baby bottles to drink liquids primarily while they are infants or young children and typically before they are able to ingest solid or semi-solid food.

SUMMARY

In general, this document describes, among other things, a feeding bottle that includes a hollow container having an inner surface, a top cap having a center opening, the top cap removably attached to a top portion of the hollow container, a nipple disposed through the top cap's center opening and held in contact by the top cap against the top portion of the hollow container, a collapsible liner disposed within the hollow container and configured to hold food, and a vacuum plate disposed within the hollow container, the vacuum plate having a shape and size such that the vacuum plate remains in moveable contact with the inner surface of the hollow container. The collapsible liner may be formed of a resilient deformable material. The nipple may have a slit configured to allow granules of food to pass therethrough.

The hollow container may have a lengthwise axis and the collapsible liner may be configured to collapse upwards along the lengthwise axis as the vacuum plate is caused to move upwards and press against the collapsible liner. The collapsible liner may have one more rigid or semi-rigid rings configured to prevent collapse of the collapsible liner in a radial direction. One or more rings may be integrally formed around a periphery of the collapsible liner. The collapsible liner may be formed as a tapered cylinder having a top radius that is larger than a bottom radius.

The feeding bottle may further include a bottom cap configured to be removably attachable to the hollow container. The bottom cap may have an opening configured to permit entry of an object into an interior of the hollow container to press against the vacuum plate. The bottom cap may have a center point that is different from a center point of the bottom cap's opening (that is, the bottom cap's opening may be off-center).

The hollow container may be a cylinder having an opening on at least one end. The hollow container has a shape other than cylindrical. Either or both of the top cap and the vacuum plate may be substantially cylindrical in shape. Either or both of the hollow container or the collapsible liner may be at least partially transparent.

The vacuum plate may be formed as a cylinder having a waist, a top lip and a bottom lip, such that the waist is disposed between the top lip and the bottom lip and has a diameter that is smaller than respective diameters of the top lip and the bottom lip. The vacuum plate may include a top elevated portion configured to at least partially extend into an interior of the nipple when the vacuum plate is in a terminal elevated state. The top elevated portion may have either a plateau shape or a convex shape.

The feeding bottle may further include one or more handles formed integrally with the top cap and/or a removably attachable lid, which may have an air hole. The removably attachable lid may have a plurality of tabs and the top cap may have a groove and a plurality of slots. The groove may be configured to receive a rim of the lid and the plurality of slots may be configured to receive the plurality of tabs in a state when the lid is attached to the feeding bottle. The groove may further be configured to allow rotation of the lid to cause the tabs to rotate into a locked state.

In another aspect, a liner for a feeding bottle includes a substantially cylindrical container having an open top and a closed bottom and configured to contain a substance to be consumed, the substantially cylindrical container formed of a resilient flexible material, a plurality of rigid or semi-rigid rings integrally formed around a circumferential surface of the substantially cylindrical container, the rings configured to allow the substantially cylindrical container to collapse in an axial direction and to prevent the substantially cylindrical container from collapsing in a radial direction.

The substantially cylindrical container may be formed as a tapered cylinder having a diameter of the closed bottom that is smaller than a diameter of the open top. The plurality of rings may be disposed along an outer surface of the substantially cylindrical container in a lengthwise axial direction and may be spaced apart at equal intervals.

In another aspect, a feeding bottle may include a hollow container configured to contain a substance to be consumed, a nipple attached to top of the hollow container and configured to allow extraction of the substance to be consumed from the hollow container, and a vacuum plate disposed within the hollow container. The vacuum plate may have a shape and size such that the vacuum plate remains in moveable contact with the inner surface of the hollow container. The vacuum plate may have a waist, a top lip and a bottom lip, the waist being disposed between the top lip and the bottom lip and having a cross-dimension (e.g., diameter) that is smaller than respective cross-dimensions of the top lip and the bottom lip. The vacuum plate may be substantially cylindrical and the cross-dimensions may be diameters. Each of the top lip and the bottom lip may contact the inner surface of the hollow container, while the waist may not contact the inner surface of the hollow container.

In another aspect a nipple for a feeding bottle includes a base portion configured to form a pressure seal with a feeding bottle, a feeding portion having an obround cylindrical shape and a flat top, the flat top having a plurality of slits for passing a substance to be consumed, and a middle portion connecting the base portion and the feeding portion. At least one of the plurality of slits may have a shape substantially that of a right angle. The middle portion may have a bulbous shape.

Details of one or more implementations of the subject matter described in this specification are set forth in the accompanying drawings and the description below. Other features, aspects, and potential advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
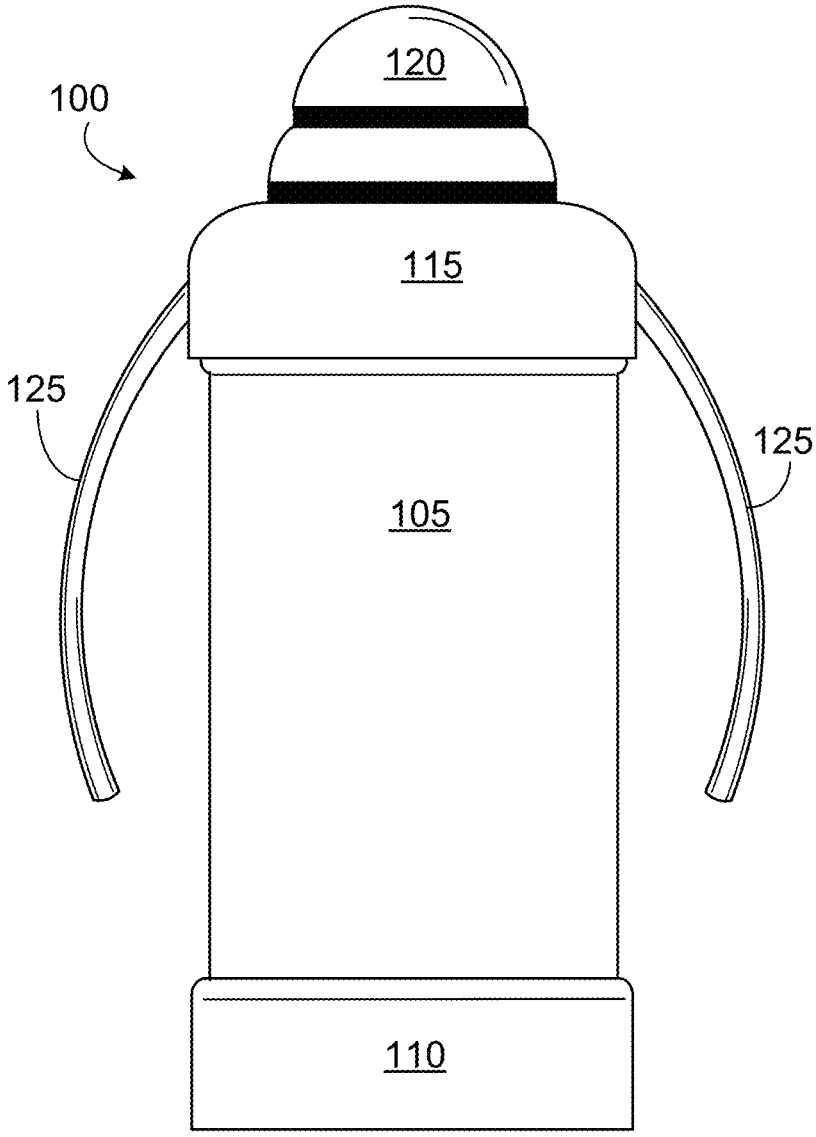
FIG. 1A is a side view of a feeding bottle.
Figure 1B:
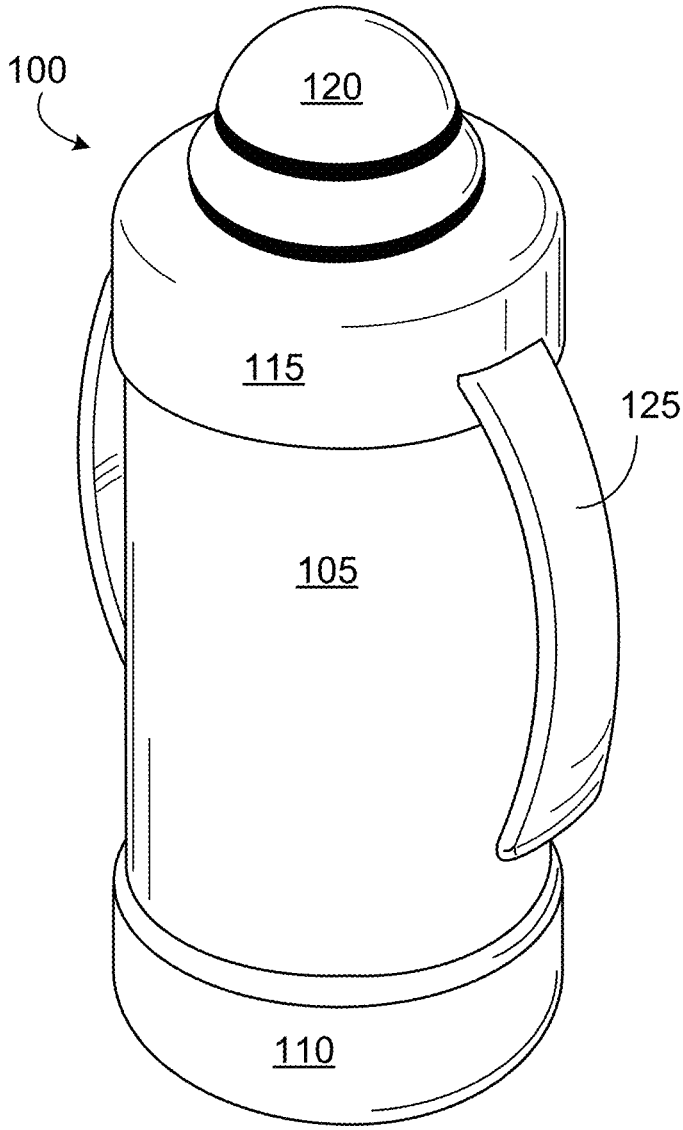
FIGS. 1B-1D are perspective views of a feeding bottle.

FIGS. 1A and 1B are side and perspective views, respectively, of a feeding bottle 100 having several features that facilitate the efficient and easy feeding, e.g., of a baby or toddler. As shown, the feeding bottle 100 is formed from a cylinder 105 (e.g., a hollow tube or other container) configured to contain foods and/or liquids and having both a top cap 115 and a bottom cap 110 releasably attached thereto, for example, by means of screw threads on the insides of the caps 110, 115 that mate with complementary threads formed on the cylinder 105. Other attachment mechanisms are possible. In addition, the shapes of the container 105 and caps 110, 115 can be other than cylindrical, for example, square, oval, triangular or the like. The feeding bottle 100 also includes handles 125, which can be formed integrally with the top cap 115, and a removable lid 120, which protects the feeding portion of the bottle 110 when not in use. The lid 120 has a vent hole (not shown) in its top to release pressure and is compatible with a variety of nipple shoes. The cylinder 105, caps 110, 115, handles 125, and lid 120 may be made of any suitably hard and strong materials, e.g., various types of high-impact plastic. In terms of size, the feeding bottle 100 components can be scaled to essentially any appropriate sizes suitable to contain a desired volume of food (e.g., 8-12 ounces).

Figure 1C:
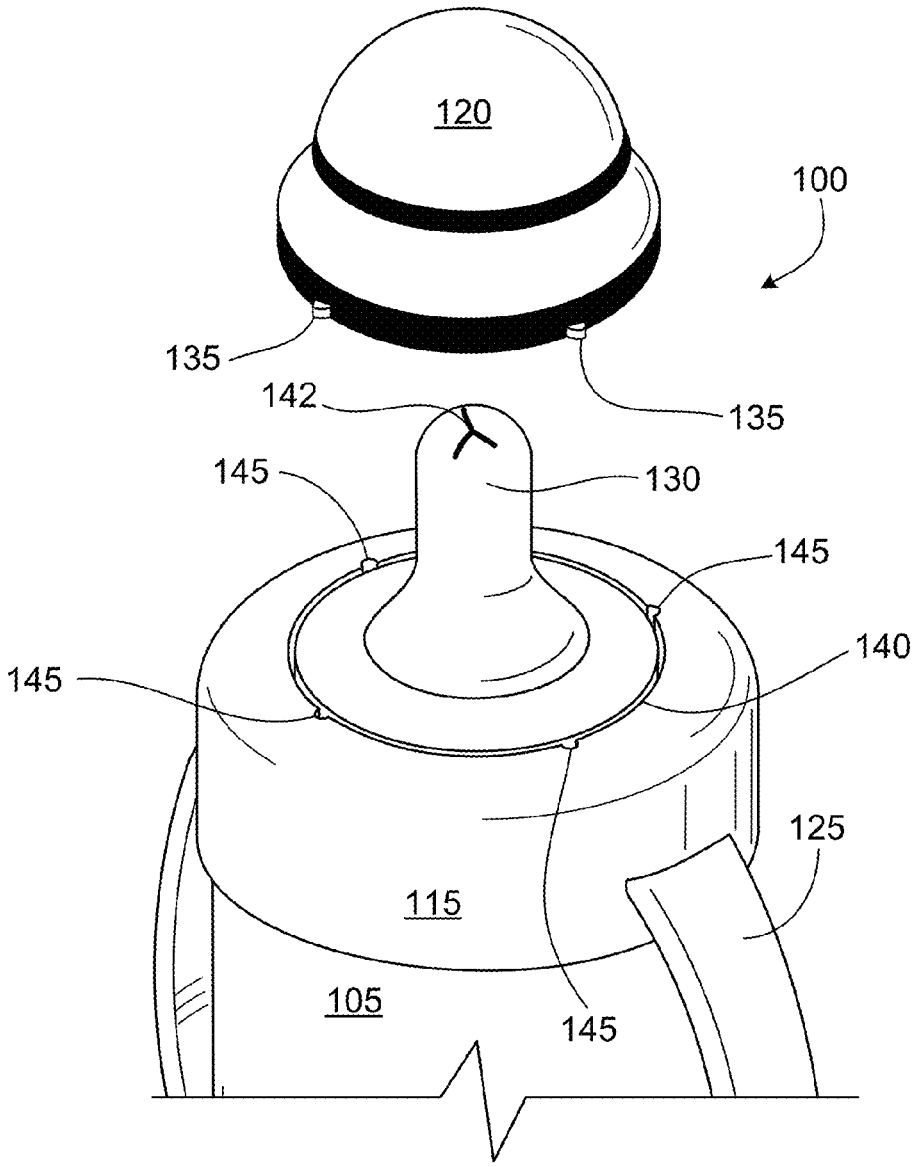

FIG. 1C is a perspective view showing a top portion of the feeding bottle 100 in which the lid 120 is in a removed state, thereby exposing the feeding nipple 130, through which the food (and/or liquid) contained in the cylinder 105 may be extracted (e.g., either through suction or pressure from below) through an opening 142 at a top portion of the nipple 130. The nipple 130 can be made of silicone rubber or any other suitably soft and resilient materials. The opening 142 can be essentially any suitable shape, a "Y" shape as shown in FIG. 1C, which facilitates the extraction of an increased volume of food or liquid through the nipple compared to a standard feeding nipple, which tend to have pinhole openings, while preventing the food or liquid from unintentionally emitting from the nipple 130. Other shapes can be used for the opening 142, for example, an "X" shape or the like.

Figure 1D:
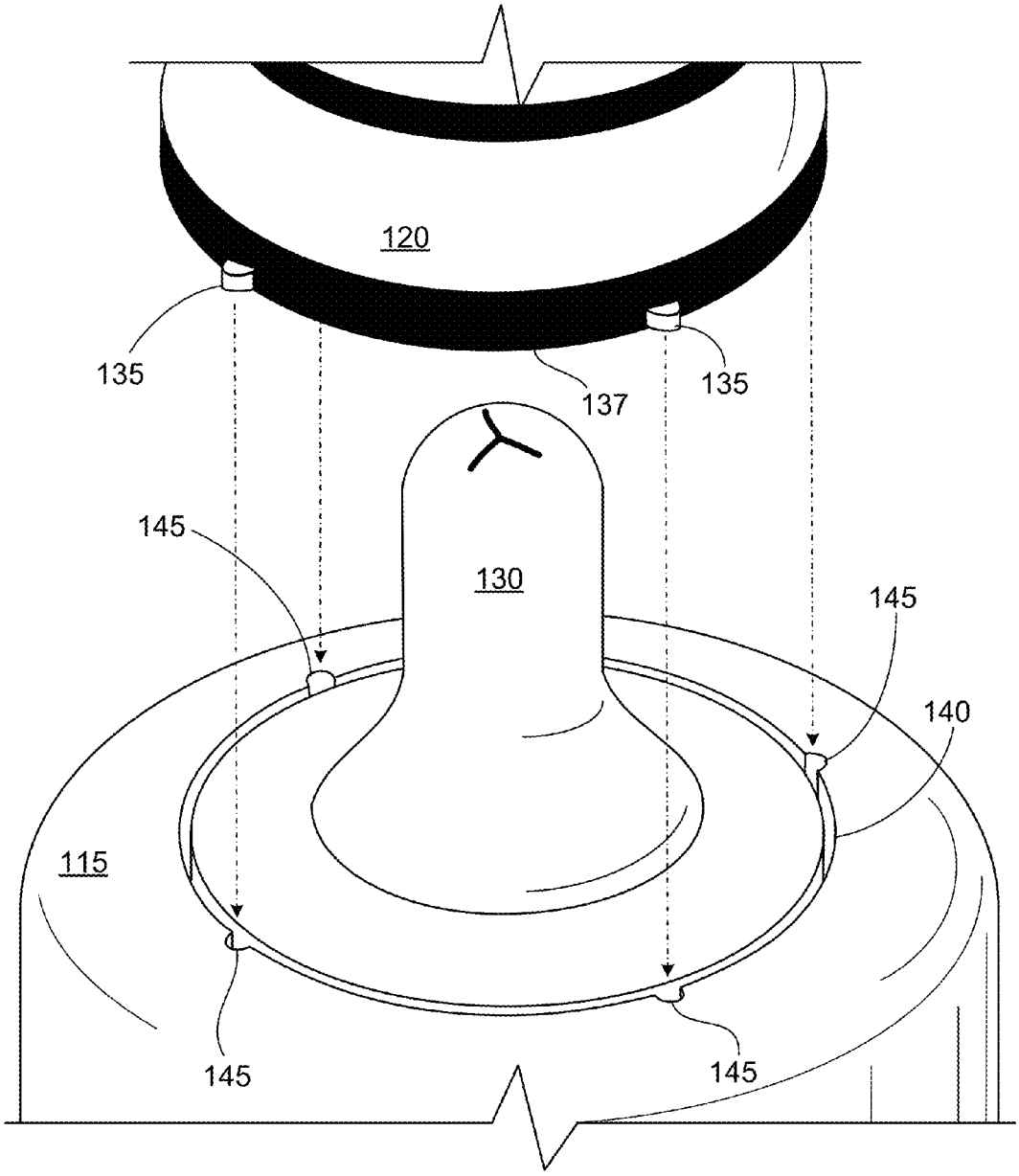

As shown in FIG. 1D, which is an enlarged view of a region around the top cap 115 of the feeding bottle 100, the lid 120 includes four tabs 135 (only two shown), one at each 90 degree position on the circular cross-section of the lid 120, which, when the lid 120 is brought into aligned contact with the top cap 115, fit into slots 145 formed at corresponding locations in the top cap 115. At the same time, a bottom rim 137 of the lid 120 fits into a corresponding circular groove 140 formed in the top cap 115. When the lid 120 is in a state such that the bottom rim 137 of the lid 120 is disposed in circular groove 140 of the top cap 115, and tabs 135 rest in respective slots 145, the lid 120 can be locked onto the top cap 115 by rotating the lid 120 in either direction relative to the top cap 115 thereby causing the tabs 135 to rotate to positions underneath an overhang portion (not shown) of the circular groove. Unlocking of the lid 120 can be achieved by rotating the lid 120 in the reverse direction until the tabs 135 line up with slots 145 and then pulling the lid 120 away from the top cap 115 in an axial direction.

Figure 1E:
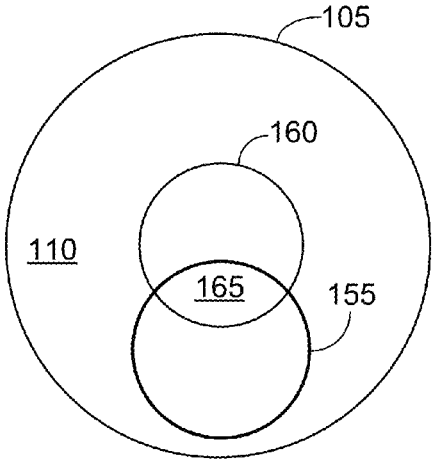
FIGS. 1E-1H are bottom views of a feeding bottle.

FIG. 1E shows a bottom view of the feeding bottle 100 in a state in which the bottom cap 110 is attached to the cylinder 105. As shown, the bottom cap 110 includes a circular opening 155, which has various purposes. For example, the circular opening 155 facilitates insertion of a human finger (or other object) to enable an adult or child to push on a vacuum plate (discussed below in relation to FIG. 2), thereby forcing the food/liquid above the vacuum plate upwards in the cylinder 105 and towards the opening 142 in the nipple 130. The circular opening 155 also allows air to enter the bottom of the cylinder 105 such that a vacuum force can be created or maintained as the child sucks on the nipple 130 and withdraws food/liquid through the opening 142.

Figure 1F:
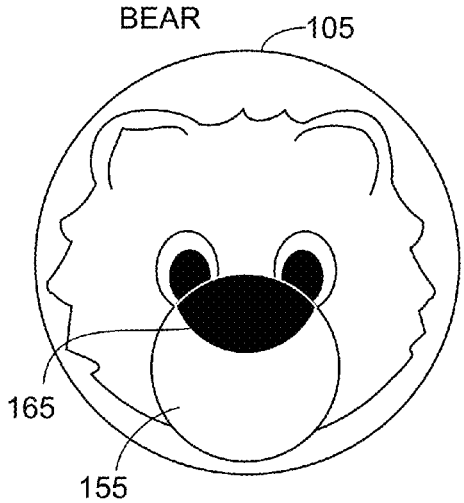
Figure 1G:
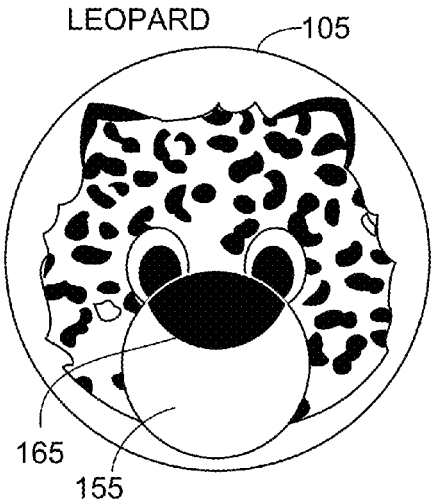
Figure 1H:
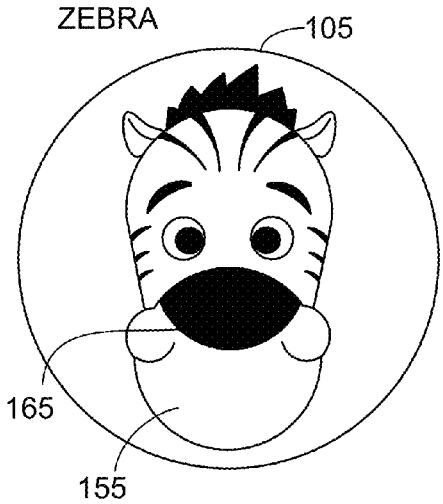

In addition, circular opening 155, due to its offset positioning (that is, a center point of circular opening 155 is not co-located with a center point of bottom cap 110), can serve an ornamental purpose. More specifically, as shown in FIGS. 1F, 1G and 1H, which are bottom views of the feeding bottle 100 with the bottom cap 110 attached, the offset circular opening 155 also forms a portion of a face of an animal character (e.g., bear, leopard or zebra). In the example shown, a nose 165 of the character is formed by the visual overlap (when viewed from the bottom) of the circular opening 155 and a center portion 160 of the vacuum plate disposed inside the cylinder 105. The remainder of the character is printed on the bottom surface of the bottom cap 110.

Figure 2:
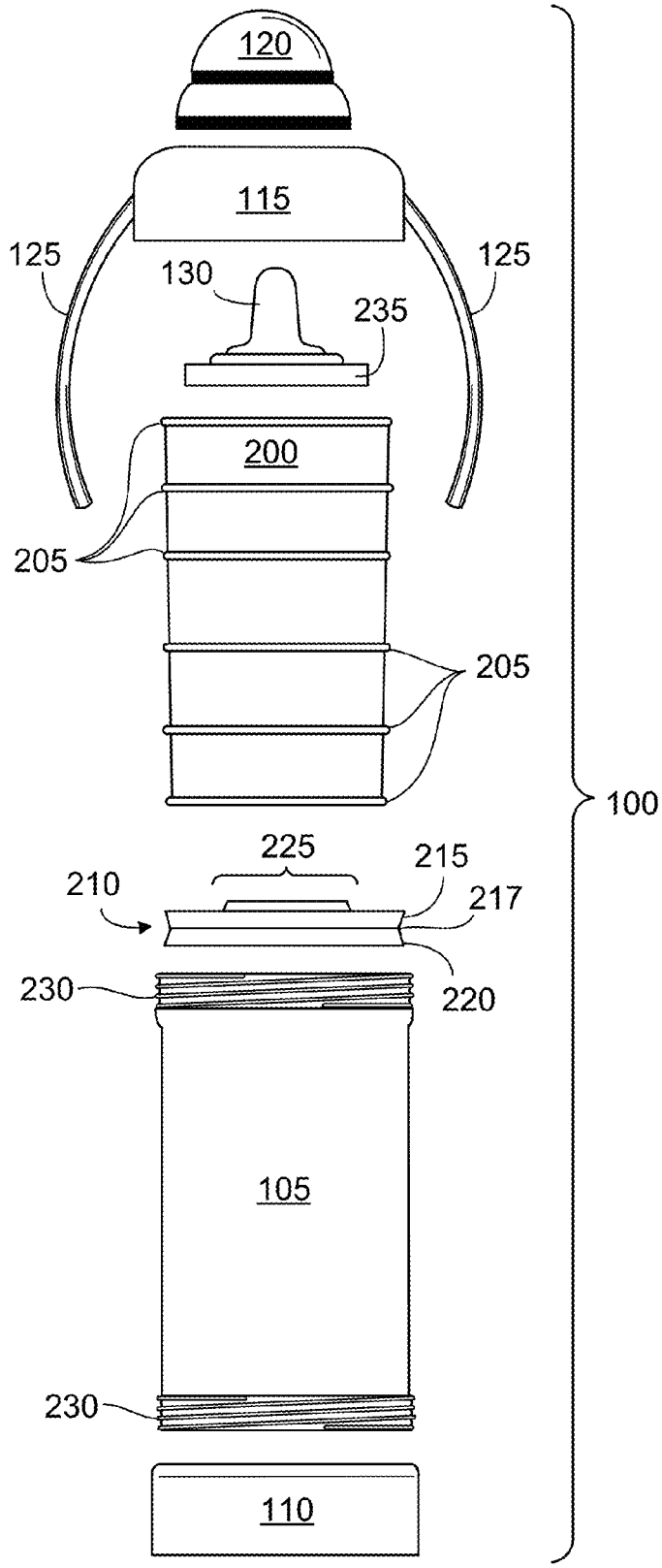
FIG. 2 is an exploded side view of a feeding bottle.

FIG. 2 is an exploded side view of the feeding bottle 100. As shown therein, starting from the bottom up, assembly of the feeding bottle 100 may proceed as follows: first, bottom cap 110 is attached to cylinder 105 by screwing it onto bottom thread 230. Next, the vacuum plate 210 is inserted inside the cylinder 105. The vacuum plate 210 has a shape (in this example, circular) and size such that the vacuum plate 210 remains in moveable contact with an inner surface of the cylinder 105, while forming an air tight, or nearly so, seal with the inner surface of the cylinder 105.

As shown in FIG. 2, the vacuum plate 210 has a dual-track configuration—that is, it has a waist 217 separating an upward facing top lip 215 and a downward facing bottom lip 200. The waisted, two-lipped configuration helps to keep the vacuum plate 210 moving smoothly and evenly within the cylinder and helps to prevent the vacuum plate 210 from tipping or being moved diagonally (i.e., one side of the vacuum plate 210 moves higher in the cylinder 105 than the other side of the vacuum plated) within the cylinder 105, which could cause food/liquid spillage and/or other device malfunction. The vacuum plate 210 also includes an upper elevated portion 225, which helps to make sure that all food/liquid in the feeding bottle 100 can be pushed up and out through the opening 142 in the nipple 130 and thus will not be wasted. The elevated portion 225 can take various forms, e.g., either the flat-topped plateau shape shown in FIG. 2 or a rounded, convex shape.

For installation, the vacuum plate 210 is pushed downward until it rests at the bottom of the cylinder 105 and in contact with a support shelf (not shown) formed at the bottom of the cylinder 105. A purpose of the vacuum plate 120 is to push food/liquid upwards as the child eats—that is, extracts food/liquid through the opening 142 in the nipple 130—as a result of a vacuum formed by sucking and extraction of liquid/food and/or as a result of a finger or other object pushing on the vacuum plate 210 from underneath.

Next, an optional liner 200 is inserted into the cylinder 105 such that it occupies essentially all of the cylinder's inside volume and rests atop the vacuum plate 210. The liner 200 is optional in the sense that the feeding bottle 100 can be used effectively without a liner 200 being inserted into the cylinder—that is, with the food/liquid being inserted directly into the cylinder 105 such that the food/liquid contacts the inner surface of the cylinder 105. However, use of the liner 200 tends to provide a tidier feeding and/or clean-up experience as doing so not only helps to prevent spillage but also makes post-feeding clean-up relatively easy—that is, the liner 200 (which can be disposable) can be thrown away and essentially all that needs to be cleaned is the nipple 130 since it is the only component that has come into contact with the food/liquid. The food/liquid to be consumed can be inserted into the liner 200 either before or after the liner 200 is inserted into the cylinder 105.

The liner 200 can have a generally cylindrical shape. As shown in FIG. 2, the liner 200 is formed substantially as a cylinder but is slightly tapered—the bottom radius being slightly smaller than the top radius—to facilitate easy insertion of the liner 200 into the cylinder 105. The liner 200, which can be made of a flexible material such as BPA-free (i.e., free of bisphenol A) plastic, is formed with multiple (e.g., six) rigid or semi-rigid rings 205 formed around the liner's circumference at evenly spaced intervals (e.g. 1 inch) from top to bottom along the height of the liner. Among other advantages, the rings 205 help to prevent the liner 200 from collapsing or compressing in a radial direction (which could clog or otherwise impede the flow of food/liquid) while enabling the liner 200 to collapse or compress in an axial direction as the food/liquid is extracted and the vacuum plate 210 moves upwards in the cylinder 105.

Next, the nipple 130 having a wide base 235 is place atop a top lip portion (not shown) of the cylinder 105 in an overlapping manner, such that when the nipple base 235 is compressed against the top lip portion, a tight seal will be formed thereby preventing the escape of food/liquid other than through the opening 142 of the nipple 130.

Next, the top cap 115 is placed atop the cylinder 105 such the nipple 130 extends through an opening (not shown) in the cylinder 105 and the nipple base 135 is disposed in between the top cap 115 and the cylinder 105. Potentially using handles 125 for leverage, the top cap 115 is rotated to attach the top cap 115 to the cylinder 105 by means of the cylinder's top threads 230. Attachment of the top cap 115 in this manner causes the top cap 115 to exert pressure against the nipple base 235 relative to the cylinder's upper lip, thereby forming a tight seal. Lastly, the lid 120 can be attached to the top cap 115 in the manner described above.

Figure 3A:
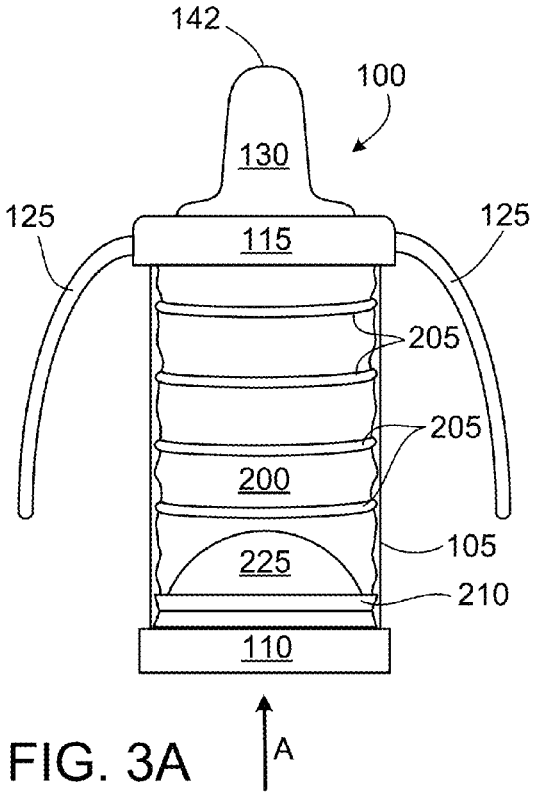
FIGS. 3A and 3B are side views showing states of a feeding bottle during usage.
Figure 3B:
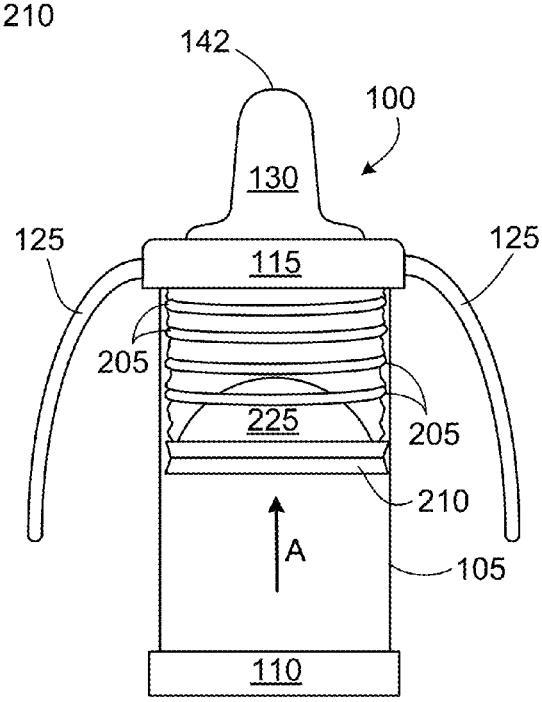

FIGS. 3A and 3B are side views showing two states of the feeding bottle 100 assembled and in use. In FIG. 3A, the feeding bottle 100 has been assembled with a liner 200 in place and full of food/liquid. In the state of FIG. 3A, the rings 205 of the liner 200 are fully separated along the length of the feeding bottle 100. In FIG. 3B, however, which shows a state in which a substantial amount of food/liquid in the bottle has been extracted, the rings 205 become compressed in an axial direction A as the liner 200 collapses towards a top portion of the cylinder 105. The liner 200 collapses in this manner due to either or both of a force exerted by a finger or other object pressing underneath vacuum plate 210 in direction A, and/or due to a suction force created by extraction of the food (e.g., caused by sucking by the child) through the opening 142 in the nipple 130.

Figure 4A:
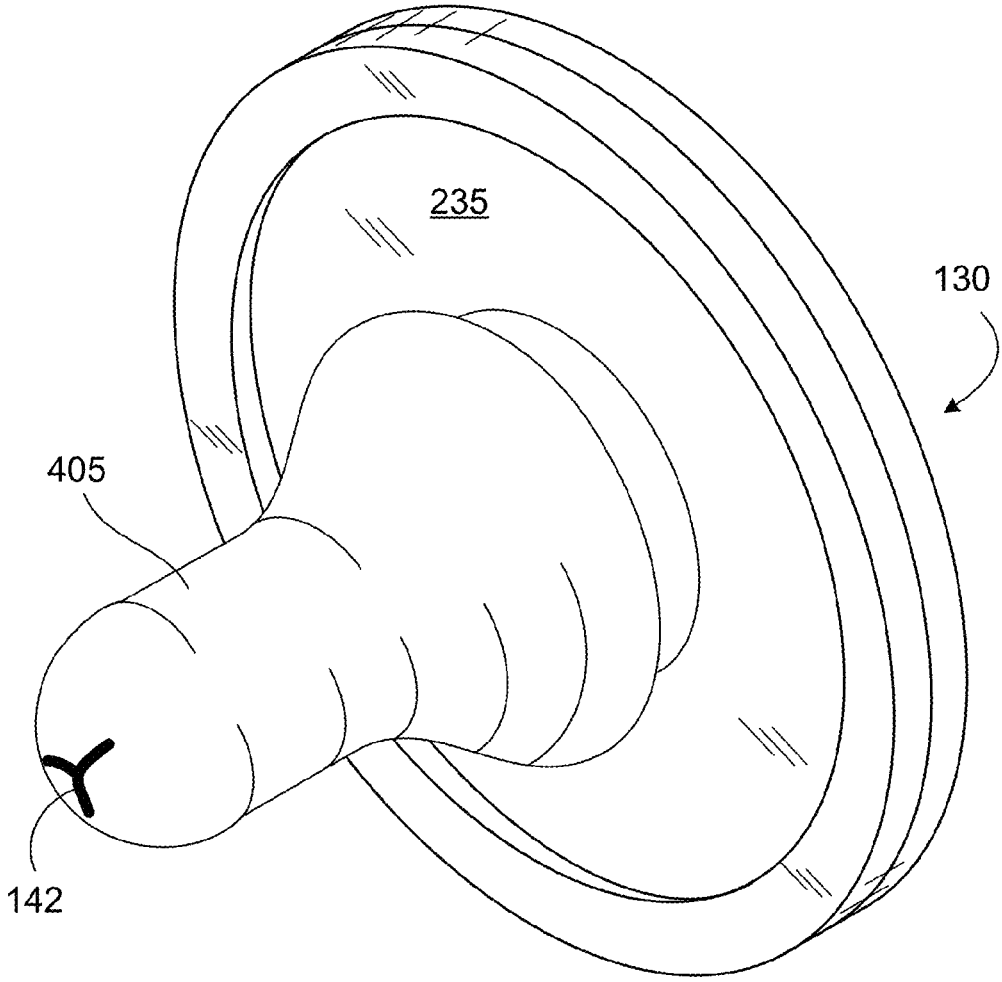
FIGS. 4A and 4B are examples of nipples that can be used with a feeding bottle.
Figure 4B:
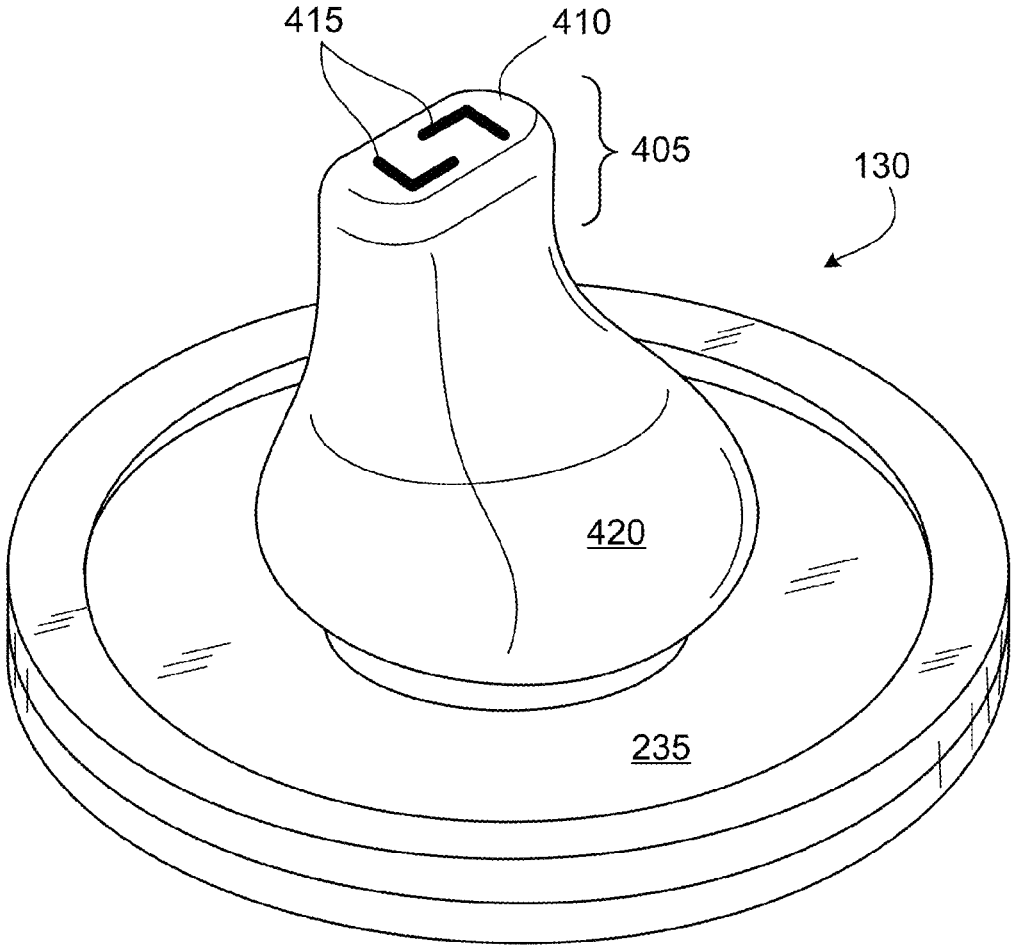

FIGS. 4A and 4B show examples of nipples that can be used with the feeding bottle 100. FIG. 4A shows a standard nipple design in which the nipple 130 has a wide base 235 and a generally cylindrical head portion 405. The nipple 130 of FIG. 4A also includes a "Y" shaped opening 142 to accommodate the passage of an enhanced volume of food/liquid.

FIG. 4B shows a graduated nipple design in which the nipple 130 has a wide base portion 235 (designed to form a pressure seal with the feeding bottle), an enlarged feeding portion 405 having a cylindrical obround shape, and a flat top 410 having two "L"-shaped slits 415 through which food/liquid (or other substance to be consumed) may be extracted. A bulbous portion 420 is disposed in between, and connects, the base portion 235 and the feeding portion 405. The slits 415 need not be "L"-shaped (equivalently, having a shape substantially that of a right angle) but can be formed in other shapes (e.g., shapes having curves and/or angles other than right angles).

This graduated nipple design, which is intended for older children, assists in transitioning the child from a bottle to a sippy cup, thereby giving the feeding bottle greater versatility and extended lifetime usage. That is, for a younger child, the feeding bottle can be used with the standard nipple design of FIG. 4A, and when the child becomes older, the same feeding bottle can be used with the graduated nipple design.

Although a few implementations have been described in detail above, other modifications are possible. Other components may be added to, or removed from, the described subject matter. Accordingly, other implementations are within the scope of the following claims.

What is claimed is:

1. A feeding bottle comprising:

a hollow container having an inner surface;

a top cap having a center opening, the top cap removably attached to a top portion of the hollow container;

a nipple disposed through the top cap's center opening and held in contact by the top cap against the top portion of the hollow container;

a collapsible liner disposed within the hollow container and configured to hold food a vacuum plate disposed within the hollow container, the vacuum plate having a shape and size such that the vacuum plate (i) remains in moveable contact with the inner surface of the hollow container, and (ii) maintains a vacuum within a portion of the hollow container in which the collapsible liner is disposed; and wherein the vacuum plate comprises a cylinder having a waist, a top lip and a bottom lip, the waist being disposed between the top lip and the bottom lip and having a diameter that is smaller than respective diameters of the top lip and the bottom lip.

2. The feeding bottle of claim 1 wherein the collapsible liner comprises a resilient deformable material.

3. The feeding bottle of claim 1 wherein the hollow container has a lengthwise axis and wherein the collapsible liner is configured to collapse upwards along the lengthwise axis as the vacuum plate is caused to move upwards and press against the collapsible liner.

4. The feeding bottle of claim 3 wherein the collapsible liner has one more rigid or semi-rigid rings configured to prevent collapse of the collapsible liner in a radial direction.

5. A feeding bottle comprising:

a hollow container having an inner surface;

a top cap having a center opening, the top cap removably attached to a top portion of the hollow container;

a nipple disposed through the top cap's center opening and held in contact by the top cap against the top portion of the hollow container;

a collapsible liner disposed within the hollow container and configured to hold food, wherein the collapsible liner has one more rigid or semi-rigid rings configured to prevent collapse of the collapsible liner in a radial direction; and a vacuum plate disposed within the hollow container, the vacuum plate having a shape and size such that the vacuum plate remains in moveable contact with the inner surface of the hollow container.

6. The feeding bottle of claim 5 wherein the one or more rings are integrally formed around a periphery of the collapsible liner.

7. The feeding bottle of claim 1 further comprising a bottom cap configured to be removably attachable to the hollow container.

8. The feeding bottle of claim 7 wherein the bottom cap has an opening configured to permit entry of an object into an interior of the hollow container to press against the vacuum plate.

9. The feeding bottle of claim 8 wherein the bottom cap has a center point that is different from a center point of the bottom cap's opening.

10. The feeding bottle of claim 1 wherein the hollow container comprises a cylinder having an opening on at least one end.

11. The feeding bottle of claim 1 wherein the hollow container has a shape other than cylindrical.

12. The feeding bottle of claim 1 wherein either or both of the top cap and the vacuum plate are substantially cylindrical in shape.

13. The feeding bottle of claim 1 wherein the collapsible liner comprises a tapered cylinder having a top radius that is larger than a bottom radius.

14. The feeding bottle of claim 1 wherein one or both of the hollow container and the collapsible liner are at least partially transparent.

15. A feeding bottle comprising:

a hollow container having an inner surface;

a top cap having a center opening, the top cap removably attached to a top portion of the hollow container;

a nipple disposed through the top cap's center opening and held in contact by the top cap against the top portion of the hollow container;

a collapsible liner disposed within the hollow container and configured to hold food; and a vacuum plate disposed within the hollow container, the vacuum plate having a shape and size such that the vacuum plate remains in moveable contact with the inner surface of the hollow container, wherein the vacuum plate comprises a top elevated portion configured to at least partially extend into an interior of the nipple when the vacuum plate is in a terminal elevated state.

16. The feeding bottle of claim 15 wherein the top elevated portion comprises either a plateau shape or a convex shape.

17. The feeding bottle of claim 1 further comprises one or more handles formed integrally with the top cap.

18. The feeding bottle of claim 1 wherein the nipple comprises a slit configured to allow granules of food to pass therethrough.

19. The feeding bottle of claim 1 further comprising a removably attachable lid.

20. The feeding bottle of claim 19 wherein the removably attachable lid comprises an air hole.

21. The feeding bottle of claim 19 wherein the removably attachable lid comprises a plurality of tabs and the top cap comprises a groove and a plurality of slots, wherein the groove is configured to receive a rim of the lid and the plurality of slots are configured to receive the plurality of tabs in a state when the lid is attached to the feeding bottle, the groove further configured to allow rotation of the lid to cause the tabs to rotate into a locked state.

22. A feeding bottle comprising:

a hollow container configured to contain a substance to be consumed;

a nipple attached to a top of the hollow container and configured to allow extraction of the substance to be consumed from the hollow container; and a vacuum plate disposed within the hollow container, the vacuum plate having a shape and size such that the vacuum plate remains in moveable contact with the inner surface of the hollow container, the vacuum plate having a waist, a top lip and a bottom lip, the waist being disposed between the top lip and the bottom lip and having a cross-dimension that is smaller than respective cross-dimensions of the top lip and the bottom lip.

23. The feeding bottle of claim 22 wherein the vacuum plate is substantially cylindrical and the cross-dimensions comprise diameters.

24. The feeding bottle of claim 22 wherein each of the top lip and the bottom lip contact the inner surface of the hollow container, and wherein the waist does not contact the inner surface of the hollow container.

* * * * *